US009289642B2

(12) United States Patent
Ho

(10) Patent No.: US 9,289,642 B2
(45) Date of Patent: Mar. 22, 2016

(54) COLLAPSIBLE PILATES EXERCISE MACHINE

(71) Applicant: Wei-Teh Ho, Taipei (TW)

(72) Inventor: Wei-Teh Ho, Taipei (TW)

( * ) Notice: Subject to any disclaimer, the term of this patent is extended or adjusted under 35 U.S.C. 154(b) by 0 days.

(21) Appl. No.: 14/158,664

(22) Filed: Jan. 17, 2014

(65) Prior Publication Data

US 2015/0202483 A1 Jul. 23, 2015

(51) Int. Cl.

| | |
|---|---|
| ***A63B 21/00*** | (2006.01) |
| ***A63B 21/055*** | (2006.01) |
| ***A63B 21/04*** | (2006.01) |
| *A63B 1/00* | (2006.01) |
| *A63B 71/02* | (2006.01) |
| *A63B 7/02* | (2006.01) |
| *A63B 23/035* | (2006.01) |

(52) U.S. Cl.

CPC ..... *A63B 21/0552* (2013.01); *A63B 21/00047* (2013.01); *A63B 21/00069* (2013.01); *A63B 21/0442* (2013.01); *A63B 21/1434* (2013.01); *A63B 21/4035* (2015.10); *A63B 21/4043* (2015.10); *A63B 1/00* (2013.01); *A63B 7/02* (2013.01); *A63B 21/4033* (2015.10); *A63B 23/03541* (2013.01); *A63B 2071/025* (2013.01); *A63B 2071/027* (2013.01); *A63B 2208/0204* (2013.01); *A63B 2208/0214* (2013.01); *A63B 2208/0242* (2013.01); *A63B 2210/50* (2013.01); *A63B 2225/093* (2013.01)

(58) Field of Classification Search

CPC ..... A63B 21/0552; A63B 2210/50; A63B 21/1457; A63B 21/1492; A63B 2225/093

USPC ..... 482/121–122, 129, 142

See application file for complete search history.

(56) References Cited

U.S. PATENT DOCUMENTS

| | | | | |
|---|---|---|---|---|
| 3,127,171 | A * | 3/1964 | Noland et al. | 482/94 |
| 5,320,591 | A * | 6/1994 | Harmon et al. | 482/129 |
| 5,405,306 | A * | 4/1995 | Goldsmith et al. | 482/120 |
| 5,551,934 | A * | 9/1996 | Binette | 482/123 |
| 6,699,162 | B2 * | 3/2004 | Chen | 482/140 |
| 6,971,975 | B2 | 12/2005 | Croft | |
| 7,137,937 | B2 | 11/2006 | Croft | |
| 7,682,298 | B2 | 3/2010 | Croft | |
| 2004/0067828 | A1 * | 4/2004 | Croft | 482/123 |
| 2005/0059536 | A1 * | 3/2005 | Croft | 482/123 |
| 2006/0122044 | A1 | 6/2006 | Ho | |
| 2008/0248935 | A1 * | 10/2008 | Solow et al. | 482/142 |
| 2009/0054215 | A1 * | 2/2009 | McBride et al. | 482/129 |
| 2009/0098987 | A1 * | 4/2009 | McBride et al. | 482/133 |
| 2010/0280549 | A1 * | 11/2010 | Yen | 606/237 |
| 2011/0118093 | A1 * | 5/2011 | Haven (Haviv) | 482/92 |
| 2013/0203569 | A1 * | 8/2013 | Athis | 482/142 |
| 2013/0210593 | A1 * | 8/2013 | McBride et al. | 482/142 |
| 2014/0194266 | A1 * | 7/2014 | Raiten et al. | 482/142 |
| 2014/0228184 | A1 * | 8/2014 | Kamenskikh | 482/124 |

* cited by examiner

*Primary Examiner* — Loan H Thanh
*Assistant Examiner* — Andrew S Lo
(74) *Attorney, Agent, or Firm* — Blakely, Sokoloff, Taylor & Zafman LLP

(57) ABSTRACT

An exerciser machine including a base frame, a pole frame and a swivel frame is described. The base frame can have longitudinally a head section and a rear section pivotally coupled with the head section. The pole frame can have one or more extendable poles extending longitudinally between a far end and a near end of the pole frame. A cross bar can be detachably affixed between the extendable poles. The pole frame may be pivotally attached to the base frame. The swivel frame can have one or more side bars having longitudinally a handle end and a pole end. A handle bar may be detachably fixed between the side bars at the handle end. The swivel frame may be rotably attached to the extendable poles to allow rotary movements of the swivel frame in between the extendable poles.

7 Claims, 3 Drawing Sheets

COLLAPSIBLE PILATES EXERCISE MACHINE

FIELD OF INVENTION

The present invention relates generally to physical training machines, and in particular, to exercise machines commonly referred to as a "Reformer" and used in Pilates type exercises.

BACKGROUND

Pilates exercise apparatuses commonly feature a foldable frame designed to fold into an upright position and to be rolled to a desired location. Typically, Pilates exercise apparatuses may be over 7 feet in length requiring a significant amount of storage space. Even when folded, the exercise apparatus with a changed length may still be bulky in size, occupying too much space for storage or during delivery.

Thus, the conventional Pilates exercise apparatuses require further improvements.

SUMMARY OF THE DESCRIPTION

An exerciser or exercise machine applicable for Pilates like exercising may include a base frame, a pole frame and a swivel frame. The base frame can have longitudinally a head section with a head end and a rear section with a rear end. The head section may be pivotally coupled with the rear section to allow folding of the base frame when the rear end of the rear section is pivoted towards the head end of the head section. The pole frame can have one or more extendable poles and a cross bar. The extendable poles can extend longitudinally between a far end and a near end of the pole frame. The cross bar can be detachably affixed between the extendable poles at the far end. The pole frame may be pivotally attached to the base frame via the near end of the pole frame and the head end of the head section to allow folding together the pole frame and the base frame. The swivel frame can have one or more side bars and a handle bar. The side bars can have longitudinally a handle end and a pole end. The handle bar may be detachably fixed between the side bars at the handle end. The swivel frame may be rotably attached to the extendable poles via the pole end to allow rotary movements of the swivel frame in between the extendable poles.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
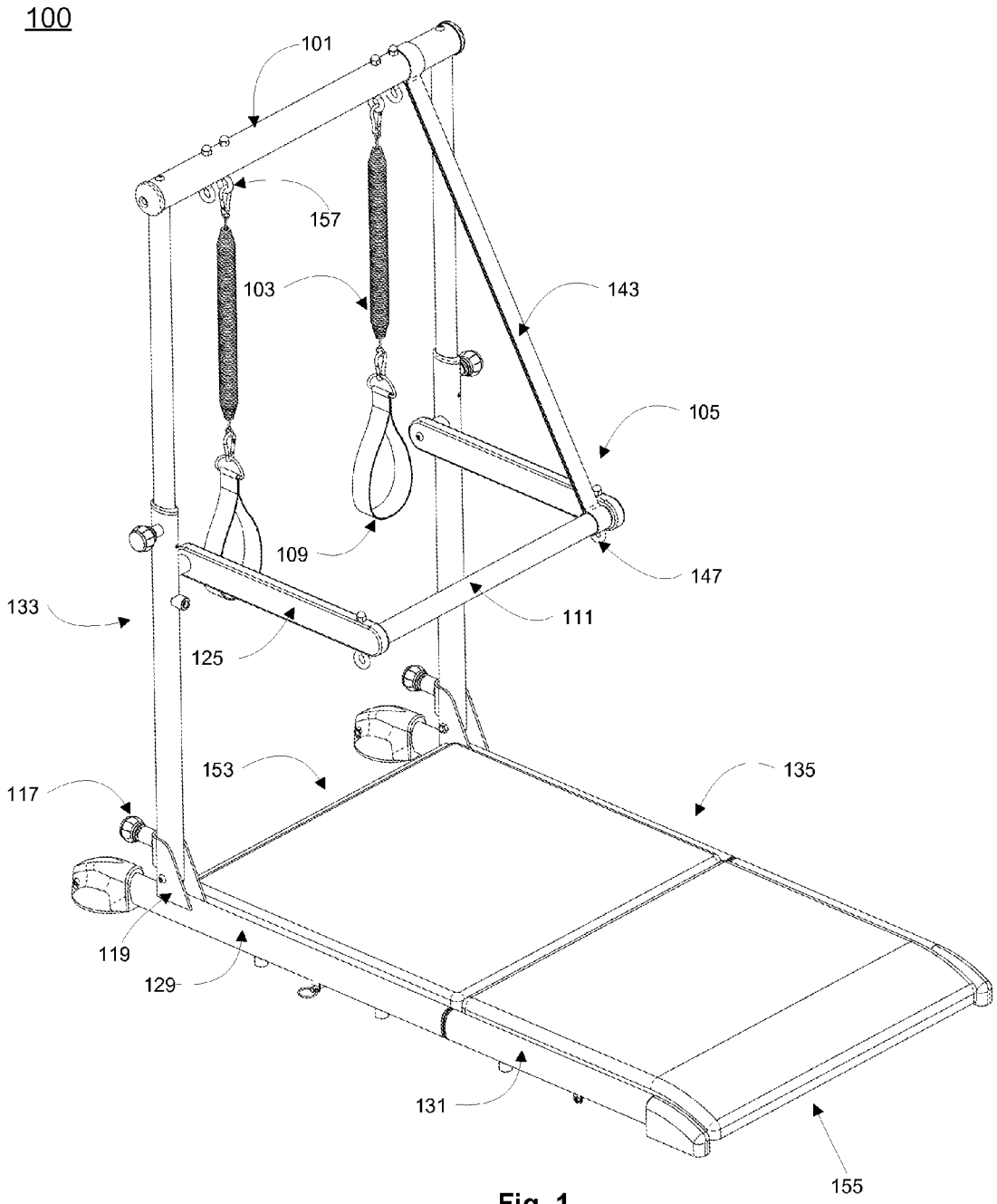
FIG. 1 is a perspective view of an exercise machine assembly according to one embodiment of the present invention.

FIG. 1 is a perspective view of an exercise machine assembly according to one embodiment of the present invention. Exercise machine (or device) 100 can include base frame 135 having longitudinally a head section 129 and a rear section 131. Base frame 135 may be defined between head end 153 of head section 129 and rear end 155 of rear section 131. Head section 129 and rear section 131 may be pivotally coupled to allow the folding of base frame 135. For example, rear section 131 can be folded against head section 129 with rear end 155 pivoted towards head end 153 to collapse base frame 135 to reduce longitudinal length of base frame 135 to about the length of head section 129.

In one embodiment, device 100 can include pole frame 133 pivotally configurable in an upright position or a folding position relative to base frame 135. Pole frame 133 can have two extendable poles and a cross bar 101. The extendable poles may be arranged substantially parallel to each other longitudinally between a far end and a near end of pole frame 133.

Pole frame 133 may be pivotally attached to base frame 135 around the near end of pole frame 133 or the head end of head section 129 to allow folding/unfolding between pole frame 133 and base frame 135. For example, base frame 135 can include holder brackets 119 to adjustably attach pole frame 133 in a pivot manner via folding control 117. In some embodiments, the extendable pole of pole frame 133 may include an upright slot. When base frame 135 and pole frame 133 are unfolded, the upright slot may be engaged with holder bracket 119 via folding control 117. When base frame 135 and pole frame 133 are folded together, the upright slot is released from holder bracket 119 via folding control 117.

Device 100 may be collapsed when pole frame 133 and base frame 135 are folded together. In some embodiments, the extendable poles may be retractable and/or extendable to adjust the longitudinal length of pole frame 133. For example, the length or height of pole frame 133 may be shortened when the extendable poles are retracted to help reduce space requirement for storing device 100.

In one embodiment, cross bar 101 may be detachably affixed at the far end of pole frame 133 between the extendable poles. Cross bar 101 can have one or more eyelets 157 (e.g. hangers or hooks) mounted to allow attachment of elastic cord members 103 to provide exercising elastic forces when extended, e.g. by a user of device 101. Grip handle 109 may be coupled with elastic cord members 103 for user holding.

In certain embodiments, device 100 can include swivel frame 105 to provide Pilates exercise supports. For example, swivel frame 105 can have two side bars 125 and handle bar 111 rotably attached to the extended poles of pole frame 133. Side bars 125 may extend longitudinally between a handle end and a pole end. Handle bar 111 may be detachably fixed between two side bars 125 at the handle end, for example, via fastener pin 147.

Swivel frame 105 may swivel or rotate around the pole end between the extendable poles. Optionally or alternatively, device 100 can include lift bar 143 detachably coupled to cross bar 101 and handle bar 111 to maintain a (e.g. fixed) rotary position of swivel frame 105 relative to pole frame 133.

Figure 2:
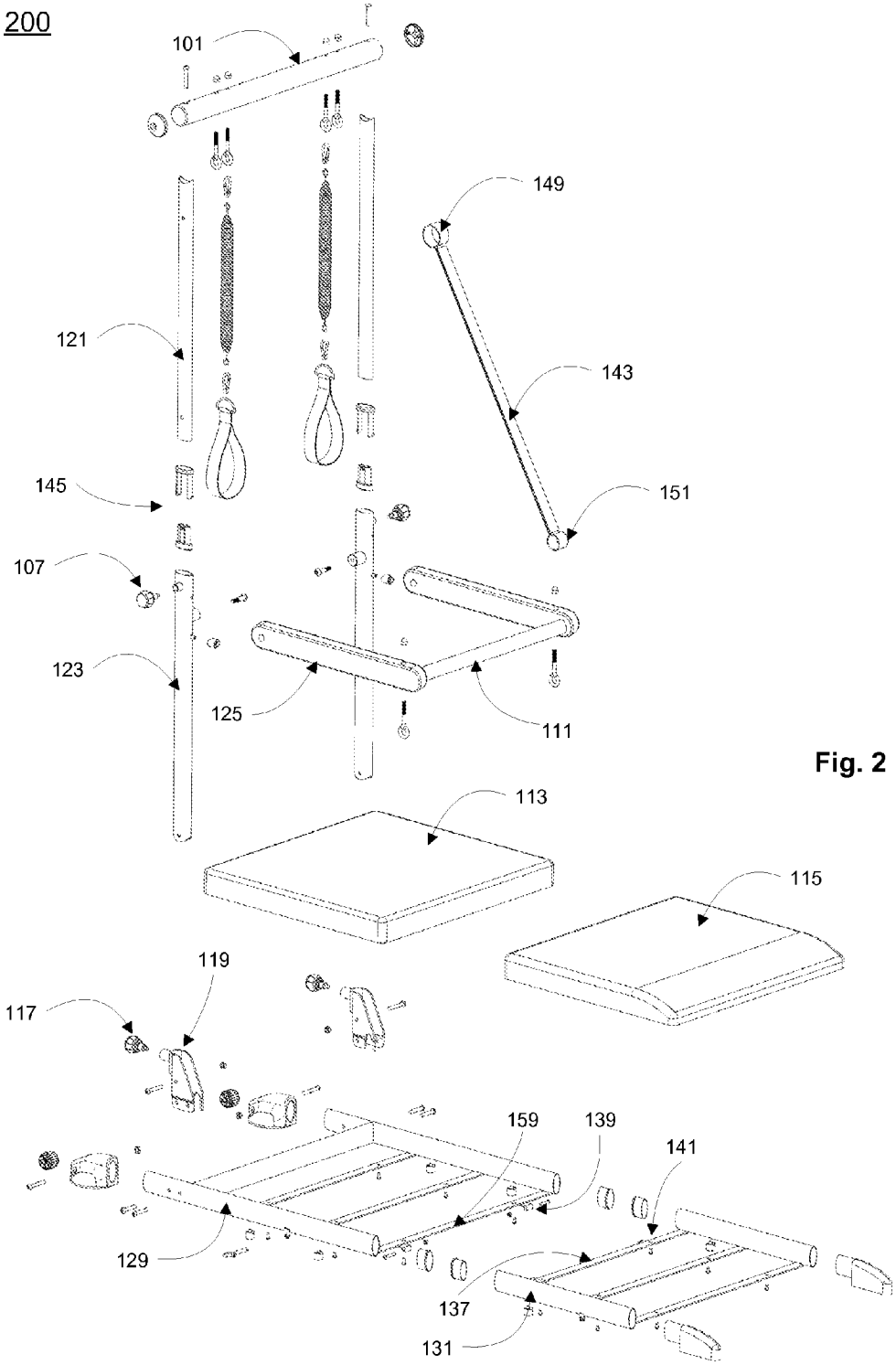
FIG. 2 is an exploded view of an exercise machine assembly according to one embodiment of the present invention.

FIG. 2 is an exploded view of an exercise machine assembly according to one embodiment of the present invention as shown in FIG. 1. For example, view 200 may be based on exercise machine 100 of FIG. 1. In one embodiment, lift bar 143 may include coupling sleeves 149, 151 at two longitudinal ends to separately engage cross bar 101 and handle bar 111. Other mechanisms may be applicable to removable attach lift bar 143 to cross bar 101 and/or handle bar 111.

In one embodiment, an extendable pole of pole frame 133 can include base pole 123 and extension pole 121 adjustably attached longitudinally within base pole 123 via locking assembly 145. One or more slots may be defined along extension pole 121. Locking assembly 145 can include extension control 107 to selectively affix base pole 123 with extension pole 121 via one of the slots to adjust overall length of the extendable pole. Extension pole 121 may be retracted within base pole 123 to shorten the length of the extendable pole.

According to certain embodiments, base frame 135 can include pivotal coupling structures 139, 141 between head section 129 and rear section 131. Head section 139 can include a pair of head bars. Rear section 131 can include a pair of rear bars. The head bars of head section 129 and the rear bars of rear section 131 may be aligned longitudinally along base frame 135 via pivotal coupling structures 139, 141.

Head section 129 of base frame 135 can include one or more cross rails transversely affixed to the pair of head bars. Rear section 131 of base frame 135 can include one or more cross rails transversely affixed to the pair of the rear bars. Pivotal coupling structures 139, 141 may be defined between a first one of the cross rails 159 of head section 129 and a second one of cross rails 137 of rear section 131. Cross rails 159, 137 may be arranged to be adjacent to each other in base frame 135.

In one embodiment, head section 129 can include head board 113 affixed to the cross rails of head section 129. Rear section 131 can include rear board 115 affixed to the cross rails of rear section 131. Head board 113 and rear board 115 may be shaped to allow surfaces of head board 113 and rear board 115 to be substantial aligned along the two dimensions of the surfaces.

Figure 3A:
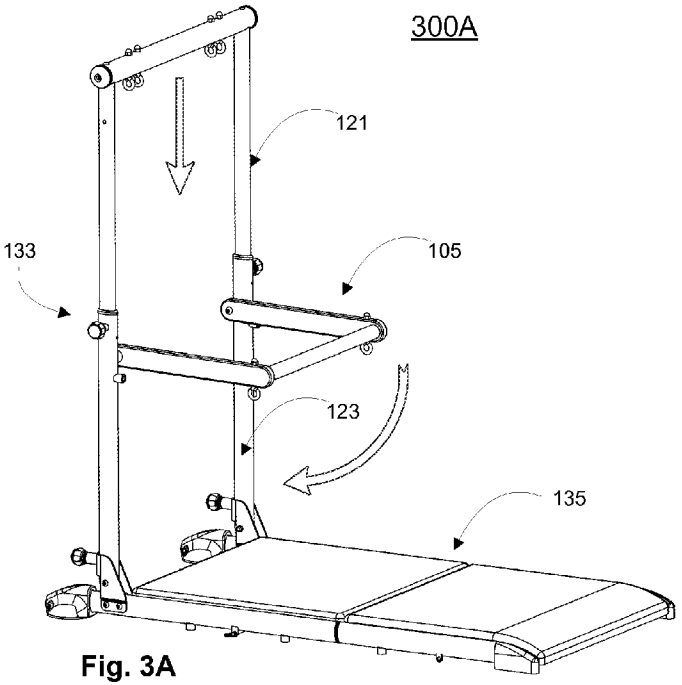
FIGS. 3A-3D illustrate an exemplary sequence of configurations to collapse the machine assembly according to one embodiment of the present invention.

FIGS. 3A-3D illustrate an exemplary sequence of configurations to collapse the machine assembly according to one embodiment of the present invention, for example, in FIG. 1. Turning now to FIG. 3A, configuration 300A may indicate an exerciser (e.g. exercise machine 100 of FIG. 1) is about to be collapsed or folded from an expanded or extended configuration. Elastic cord members and a lift bar may have already been detached or removed from pole frame 133 and swivel frame 105. Extension pole 121 may be retracted into base pole 123. Swivel frame 105 may swing towards the rear side of pole frame 133.

Figure 3B:
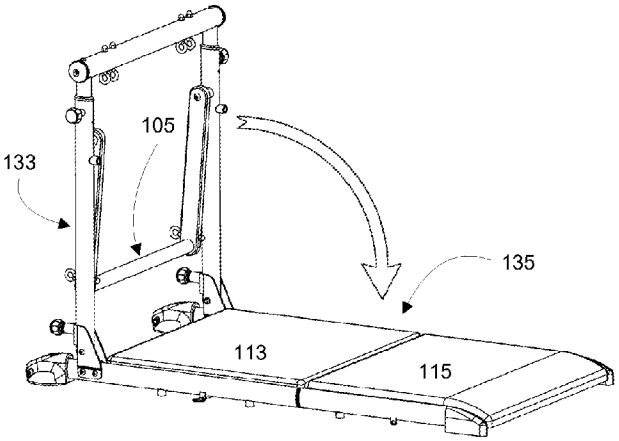

Turning now to FIG. 3B, configuration 300B may indicate an exerciser having pole frame 133 in a retracted mode. Swivel frame 105 may be folded aligned within inner space of pole frame 133. Retracted pole frame 133 and swivel frame 105 may be folded or pivoted towards base frame 135 to collapse the exerciser.

Figure 3C:
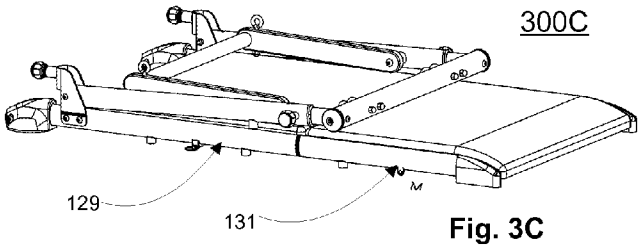

Turning now to FIG. 3C, configuration 300C may indicate an exerciser with pole frame 133, swivel frame 105 and base frame 135 folded or collapsed flat together. Base frame 135 in configuration 300C may still be in an extended mode with rear section 131 unfolded from head section 129.

Figure 3D:
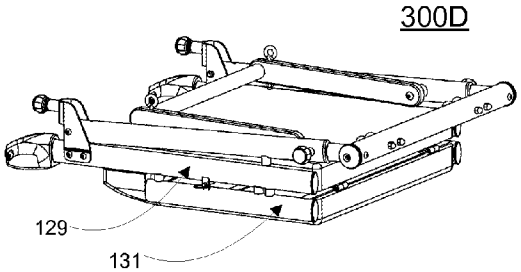

Turning now to FIG. 3D, configuration 300D may indicate an exerciser collapsed in length and height convenient for storage and/or delivery. Rear section 131 of and head section 129 of base frame 135 may be pivoted or folded together with rear section 131 and pole frame 133 resting on opposite sides of head section 129. In some embodiments, longitudinal lengths of retracted pole frame 133 and folded base frame 135 may be defined (e.g. as substantially similar) to allow compact storage for the exerciser in configuration 300D.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exerciser comprising:

a base frame having longitudinally a head section and a rear section, the head section having a head end, the rear section having a rear end, the head section pivotally coupled with the rear section to allow folding of the base frame when the rear end of the rear section is pivoted towards the head end of the head section;

a pole frame having two extendable poles and a cross bar, the extendable poles extending longitudinally between a far end and a near end of the pole frame, the cross bar detachably affixed between the extendable poles at the far end, the pole frame pivotally attached to the base frame via the near end of the pole frame and the head end of the head section to allow folding together the pole frame and the base frame; and a swivel frame having two side bars and a handle bar, the side bars having longitudinally a handle end and a pole end, the handle bar detachably fixed between the side bars at the handle end, the swivel frame rotably attached to the extendable poles via the pole end to allow rotary movements of the swivel frame in between the extendable poles, wherein the base frame includes holder brackets on the head end of the head section and wherein the pole frame is adjustably attached to the holder brackets in a pivot manner, wherein each extendable pole includes a base pole and an extension pole adjustably attached longitudinally within the base pole, wherein more than one slots are defined along the extension pole and wherein the extendable pole includes an extension control to selectively affix the base pole with extension pole via one of the slots to adjust overall length of the extendable pole, and wherein the base pole includes an upright slot, wherein when the base frame and the pole frame are unfolded, the upright slot is coupled to the holder brackets via a folding control, and wherein when the base frame and the pole frame are folded, the holder brackets are uncoupled from the upright slot via the folding control.

2. The exerciser of claim 1, further comprising:

a lift bar detachably coupled to the cross bar and the handle bar to maintain a rotary position of the swivel frame relative to the pole frame.

3. The exerciser of claim 2, wherein the lift bar includes coupling sleeves, wherein the cross bar and the handle bar are separately coupled with the lift bar through the coupling sleeves.

4. The exerciser of claim 1, wherein the base frame includes a pivotal coupling structure between the head section and the rear section, wherein the head section includes a pair of head bars, wherein the rear section includes a pair of rear bars, and wherein the head bars and the rear bars are aligned longitudinally along the base frame via the pivotal coupling structure.

5. The exerciser of claim 4, wherein the head section includes one or more cross rails transversely affixed to the pair of head bars, wherein the rear section includes one or more cross rails transversely affixed to the pair of the rear bars, and wherein the pivotal coupling structure is defined between a first one of the cross rails of the head section and a second one of the cross rails of the rear section, the first cross rail and the second cross rail being adjacent to each other.

6. The exerciser of claim 5, wherein the head section includes a head board affixed to the cross rails of the head section, wherein the rear section includes a rear board affixed to the cross rails of the rear section, and wherein the head board and the rear board are shaped to allow surfaces of the head board and the rear board to be substantially aligned two dimensionally.

7. The exerciser of claim 1, wherein the cross bar have one or more eyelets mounted along the cross bar, each eyelet to allow attachment of an elastic cord member to provide exercising elastic forces when extended.

* * * * *